US006095374A

United States Patent [19]

Ricard et al.

[11] Patent Number: 6,095,374

[45] Date of Patent: Aug. 1, 2000

[54] CLOSURE FOR SUPPORTING A CONTAINER OF VISCOUS LIQUID

[75] Inventors: Paul J. Ricard, Amherst; David Kroll, Westfield; Robert Engman, Easthampton, all of Mass.

[73] Assignee: Good Idea!, Inc., Northampton, Mass.

[21] Appl. No.: 09/268,391

[22] Filed: Mar. 15, 1999

[51] Int. Cl.[7] ..... B67D 5/64

[52] U.S. Cl. ..... 222/173; 222/556; 222/546

[58] Field of Search ..... 222/173, 179.5, 222/206, 212, 544, 545, 546, 142.3, 556

[56] References Cited

U.S. PATENT DOCUMENTS

| | | | |
|---|---|---|---|
| 3,172,575 | 3/1965 | Vosburg | 222/185 |
| 3,342,379 | 9/1967 | Foley | 222/179.5 |
| 3,674,181 | 7/1972 | Marks et al. | 222/179.5 |
| 3,817,426 | 6/1974 | Fooks | 222/179.5 |
| 4,723,671 | 2/1988 | Mears | 215/228 |
| 4,930,668 | 6/1990 | Krall | 222/212 |
| 4,993,606 | 2/1991 | Bolen, Jr. et al. | 222/546 |
| 5,020,702 | 6/1991 | James | 222/529 |
| 5,118,012 | 6/1992 | Miller et al. | 222/179.5 |
| 5,169,035 | 12/1992 | Imbery, Jr. | 222/212 |
| 5,292,035 | 3/1994 | Millar | 222/185 |
| 5,356,018 | 10/1994 | Dubach | 215/237 |
| 5,421,488 | 6/1995 | Ehrbar | 222/185 |
| 5,547,091 | 8/1996 | Neveras et al. | 215/237 |
| 5,769,280 | 6/1998 | Ehresmann | 222/185.1 |
| 5,848,731 | 12/1998 | Deering | 222/212 |

*Primary Examiner*—Kevin Shaver
*Assistant Examiner*—David Deal
*Attorney, Agent, or Firm*—William C. Crutcher

[57] ABSTRACT

An improved supporting closure for a container adapted to hold a viscous liquid and having an externally threaded neck comprising a pivotably connected dispensing cap and a container support. The dispensing cap has an internally threaded, dual diameter, section arranged to fit two sizes of threaded necks, and a projecting end piece defining a dispensing outlet. The container support comprises a substantially dish-shaped member with a peripheral skirt adapted to rest on a flat supporting surface and a central recessed section to receive the projecting end piece of the dispensing cap and a plug to block the dispensing outlet when the container is supported in an inverted position.

9 Claims, 3 Drawing Sheets

CLOSURE FOR SUPPORTING A CONTAINER OF VISCOUS LIQUID

This invention relates generally to closure devices and more particularly to a closure for supporting a container of viscous liquid such as ketchup, and more particularly to a dispensing closure adapted to support the container in an inverted position.

BACKGROUND OF THE INVENTION

Conventional containers for viscous liquid normally have a threaded cap, which is removed to shake or squeeze out the viscous liquid. The containers may either be flexible or rigid, and some closures include a supplementary cap or removable cover adapted to cover up a dispensing outlet in the closure. As the viscous liquid is used up, the contents accumulate in the lower end of the container opposite the closure and have to be shaken or momentarily held in an inverted position to allow the contents to reach the dispensing outlet.

Many approaches have been made for solving this problem. One approach is to add another outlet on the bottom of the bottle as shown in U.S. Pat. No. 5,421,488 issued Jun. 6, 1995 to Ehrbar. Many patents, such as U.S. Pat. No. 5,769,280 issued Jun. 23, 1998 to Ehresmann, disclose an inverted bottle holder, which requires removal from the stand and usage in the conventional manner. U.S. Pat. No. 3,172,575 issued Mar. 9, 1965 to Vosburg discloses a stand for a liquid fluid dispenser such as ink or the like. This fluid dispenser is always open for continual supply of the fluid to an ink pad.

U.S. Pat. No. 4,930,668 issued Jun. 5, 1990 to Krall inverts the container on a special support which will allow the contents to flow through an outlet in the support when the container is raised within the support and the container wall is flexed. This requires liquid to flow from a well in the support itself.

A number of U.S. patents have disclosed closure devices adapted to fit a threaded neck on a container and having a supplementary cap which is pivoted on a living hinge on the periphery of the closure, and which provided a plug member blocking a smaller dispensing outlet in the closure member. Exemplary of such patents are U.S. Pat. No. 5,169,035 issued Dec. 8, 1992 to Imbery, U.S. Pat. No. 5,356,018 issued Oct. 18, 1994 to Dubach, U.S. Pat. N. 5,547,091 issued Aug. 20, 1996 to Neveras, et al and U.S. Pat. No. 4,723,671 issued Feb. 9, 1988 to Mears. Instead of using an integral hinge, a two-piece dispensing closure is shown in U.S. Pat. No. 4,993,606 issued Feb. 19, 1991 to Bolen, Jr., et al.

Lastly, the prior art has suggested an inverting support for containers having necks of various sizes. One such support is shown in U.S. Pat. No. 5,292,035 having a flexible compression sleeve adapted to fit bottles and containers having spouts of various sizes and shapes. This U.S. Pat. No. 5,292,035 issued Mar. 8, 1994 to Millar requires a multi piece structure using flexible flanges together with a compression sleeve and seal to receive the spouts.

It would be desirable to have a simplified supporting closure assembly which supports the container in an inverted position and blocks any escape of the viscous liquid in the container, yet which easily pivots out of the way to a dispensing position. The improved closure would desirably also fit threaded containers of more than one neck diameter.

Accordingly, one object of the present invention is to provide an improved supporting closure assembly for a container adapted to hold and dispense a viscous liquid.

Another object of the invention is to provide an improved closure which will support the container in an inverted position and which fits more than one size container neck.

Another object of the invention is to provide an improved closure support which easily dispenses viscous liquids and closes reliably to store the liquid in the container in an inverted position without leakage.

DRAWING

These and many other objects will become apparent by reference to the following description, taken in connection with the accompanying drawing, in which:

FIG. 1 is a perspective view of a container of viscous liquid supported in an inverted position on the improved supporting closure assembly, FIG. 2 is a perspective view of the supporting closure assembly with the container support pivoted out of the way so as to allow the viscous liquid to be dispensed, FIG. 3 is a side elevational view in cross section of the dispensing cap member, FIG. 4 is a bottom plan view of the dispensing cap member looking in the direction of IV—IV of FIG. 3, FIG. 5 is a side elevational view in cross section of the container support portion of the supporting closure assembly, FIG. 6 is a side elevational view in cross section of the assembled supporting closure assembly with the dispensing cap closed, as depicted in FIG. 1, and also FIG. 7 is a side elevational view in cross section of the supporting closure assembly with the container support pivoted to dispense liquid, as depicted in FIG. 2, FIG. 8 is a side elevational view in cross section of a portion of a container with a small diameter neck threaded to the dispensing cap, and FIG. 9 is a side elevational view in cross section of a portion of a container with a large diameter neck threaded to the dispensing cap.

SUMMARY OF THE INVENTION

Briefly stated, the invention comprises an improved supporting closure assembly for a container adapted to hold a viscous liquid and having an externally threaded neck on one end thereof, the supporting closure assembly comprising a dispensing cap and a container support, pivotably connected to one another. The dispensing cap has an internally threaded section arranged to fit the threaded neck, a projecting end piece defining a dispensing outlet, and a lateral projection disposed between the dispensing outlet and the threaded section, the threaded projection defining a first pivot member thereon. The container support comprises a substantially dish-shaped member with a peripheral skirt terminating in a peripheral edge adapted to rest on a flat supporting surface, the dish-shaped member defining a central recessed section, adapted to receive the projecting end piece of the dispensing cap and incorporating a plug to block the dispensing outlet. The dish-shaped member includes a second pivot member disposed between the peripheral edge and the central recessed section and adapted to cooperate with the first pivot member. The pivot members are located and arranged so that the projecting end piece of the dispensing cap will pivot into the central recessed section of the container support to block the dispensing outlet, whereby the dish-shaped member may serve as a support to hold the container in an inverted position, and whereby the projecting end piece of the dispensing cap is pivotable out of the central recessed section to permit dispensing viscous fluid from the dispensing outlet. In the preferred embodiment, the dispensing cap internally threaded section has two or more diameters of internal threads so as to fit two or more sizes of threaded container necks.

DESCRIPTION OF THE PREFERRED EMBODIMENT

Figure 1:
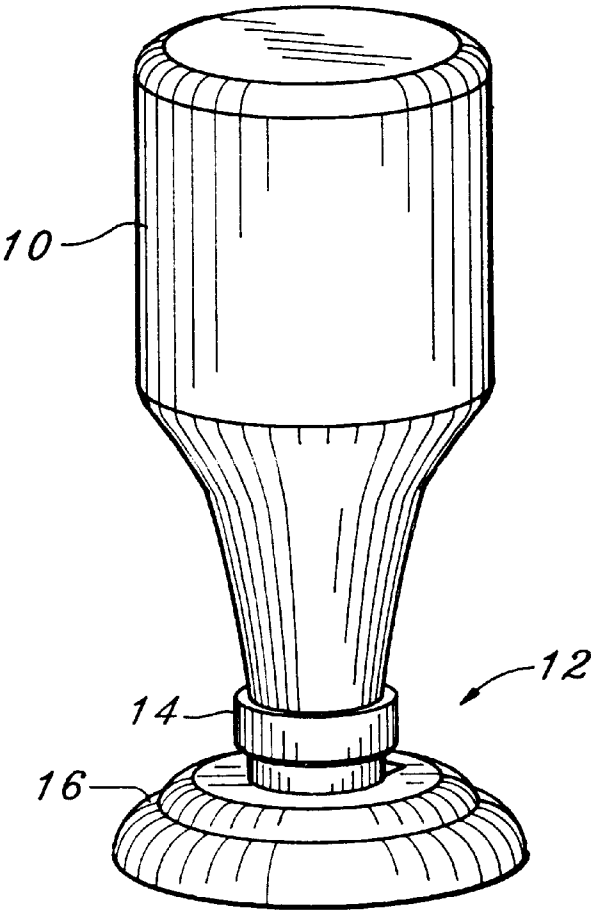

Referring to FIG. 1 of the drawing, a container 10 adapted to hold a viscous liquid, such as ketchup, mustard, sauce, shampoo, hand lotion, oil products, or the like is supported in an inverted position on the improved supporting closure assembly, shown generally at 12. The supporting closure assembly 12 is made up of a dispensing cap 14 and a container support 16.

Figure 2:
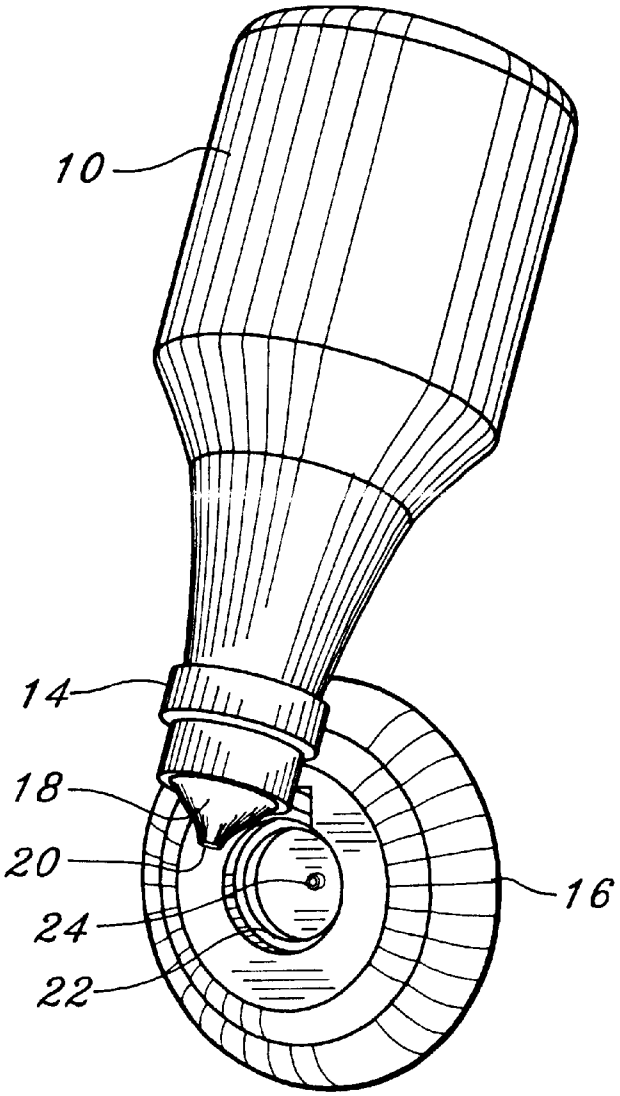

Reference to FIG. 2 shows that the container support 16 is pivotable with respect to the dispensing cap 14 so as to expose a projecting end piece 18 on the dispensing cap having a dispensing outlet 20. The container support comprises a substantially dish-shaped member having a central recessed section 22 adapted to receive the projecting end piece 18 and a centrally located projecting plug 24 arranged to close off and block the dispensing outlet 20 when the closure is repivoted to the position shown in FIG. 1.

Figure 3:
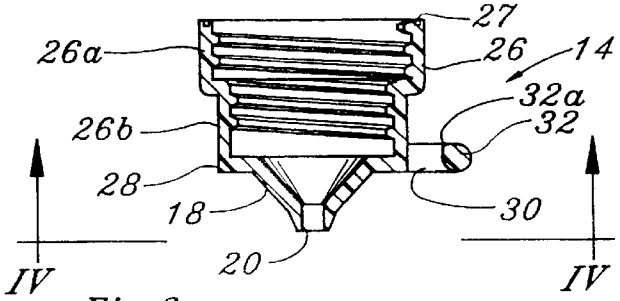
Figure 4:
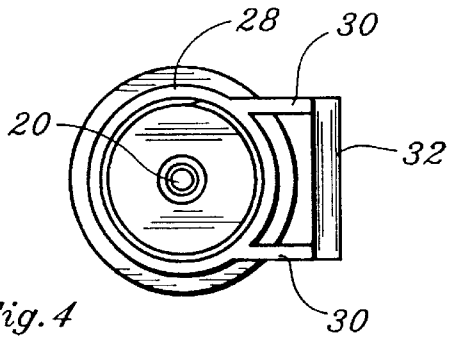

Referring to FIGS. 3 and 4 of the drawing, the dispensing cap part of the support enclosure will be described. As seen in the cross sectional view, the dispensing cap 14 comprises a larger diameter internally threaded portion 26*a* connected to a smaller diameter internally threaded portion 26*b*. The two portions are coaxial with one another, and are referred to together herein as threaded section 26. The top edge of dispensing cap 14 may be provided with circumferentially spaced gripper pockets 27 for added flexibility.

As seen previously in FIG. 2, the projecting end piece 18 is substantially conical and terminates in dispensing outlet 20. A short peripheral rim 28 surrounds the base of the projecting end piece 18. Referring to the bottom plan view of FIG. 4, rim 28 is extended to form a pair of lateral arms 30, which support opposite ends of a first pivot pin member 32. Pivot pin member 32 has a substantially circular cross section, so as to serve as a pivot for dispensing cap 14, with a detent 32*a* thereon to hold it at a selected open position.

Figure 5:
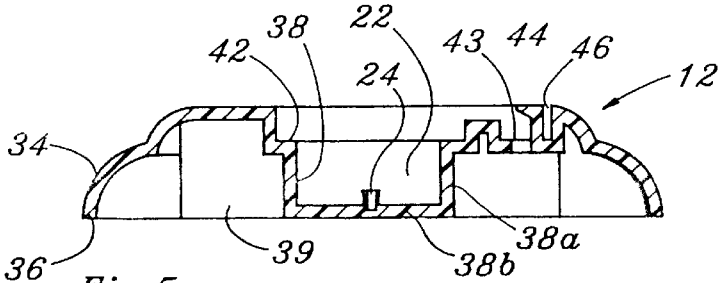

Referring to the cross sectional view of FIG. 5, the container support portion will be described. Container support 12 is a generally dish-shaped member having a peripheral skirt 34 terminating in a peripheral edge 36. The periphery may be circular, oval or irregularly shaped for various aesthetic effects. The central portion of the container support includes the recessed section 22, which is shaped to provide a reservoir 38 with vertical wall 38*a* and bottom wall 38*b* which receives the projecting end piece 18 of cap 14. Supporting ribs 39 (only one shown) extend radially from reservoir wall 38*b* to the peripheral skirt 34 for rigidity. The previously referenced projecting plug 24 in the bottom of the recessed portion is arranged to enter and seal off the end of the dispensing outlet 20. The central recessed portion 22 further includes an intermediate ledge 42, which is arranged to receive and support the peripheral rim 28 of the dispensing cap. Any excess viscous fluid is retained in reservoir 38.

The bottom wall 38*b* of the reservoir 38 may extend to the same plane as that containing the peripheral edge 36.

A second pivot member is formed by a chordal recess 43 in the container support between the peripheral skirt 34 and the recessed portion 22. The recess 43 runs in a "chordal" (i.e., perpendicular to a radial line from the center of the support) direction. The chordal recess 43 has a length and width adapted to receive the first pivot member 32. The recess includes an overhanging lip 44 to retain the pivot member 32 in the recess with a snap fit. The necessary resilience of the overhanging member 44 is provided by means of a chordal slot 46 adjacent and parallel to the chordal recess 43.

While the preferred first and second pivot members are shown respectively as pivot pin 32 on the dispensing cap and retainer slot 43 on the container support, it is within the purview of the present invention to reverse the functions of the pivot members, so that the projecting or pivot pin member is on the container support and the receiving or pivot slot member is on the dispensing cap.

The dispensing cap and container support are preferably molded by injection molding from a suitable plastic material such as polyethylene or polypropylene. It is important to note that the diameter of the container support of FIG. 5 is preferably greater than the diameter of the container to be supported, thereby adding stability and resistance to tipping, especially when the container is relatively full of viscous liquid so that the center of gravity is high. Since the diameter of the support is large, there may be some flexibility of the support walls. Therefore, it is preferable for the bottom wall 38*a* of the recessed portion 38 to extend to the plane of the peripheral edge 36, so that the container is partially supported by the central recessed portion 38. This also insures that the projecting plug 24 receives pressure from the supporting surface to maintain the closure of dispensing outlet 20. Resistance to tipping over is provided by the extended peripheral skirt 34 in a manner which should be apparent from the drawing. Internal radial webs 39 give added stability. The upper surface of the peripheral skirt allows the addition of decorative indicia or textures, which when used with an irregular peripheral shape, allow for a variety of designs.

Figure 6:
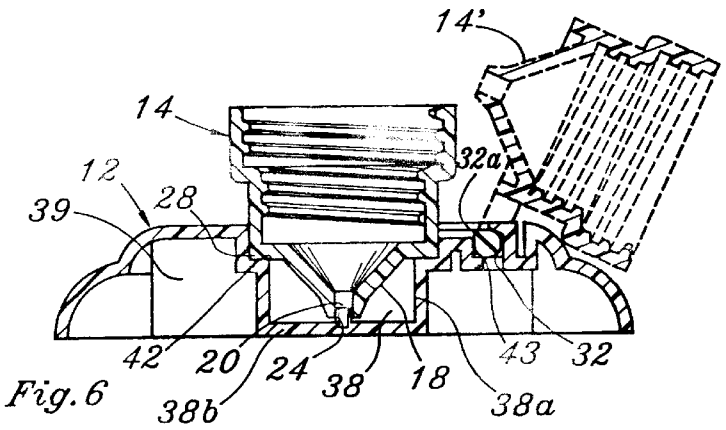

FIG. 6 illustrates the assembled support closure pivoted to the supporting position with the dispensing outlet 20 closed by the projecting plug 24. The projecting end piece 18 is received within the reservoir 38 of the central recessed portion 22. A seal against leakage is provided by the peripheral rim 28 resting on the intermediate supporting ledge 42. The extent of pivoting permitted by pivot member 32 in recess 42, and assisted by stop 32*a* is indicated by the dotted line position of the dispensing cap, indicated at reference numeral 14'.

Figure 7:
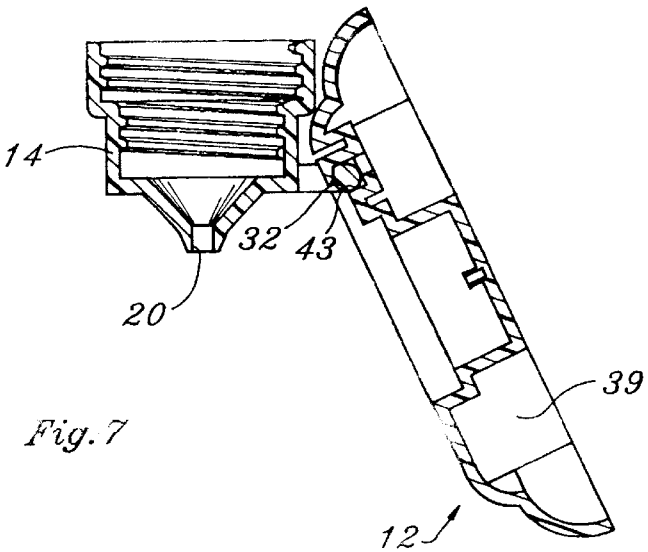

FIG. 7 illustrates the container support 12 pivoted away from dispensing cap 14, so that dispensing outlet 20 is free to dispense fluid. The pivoting connections 32, 42 with detent 32*a* permitting about 115° total rotational movement.

Figure 8:
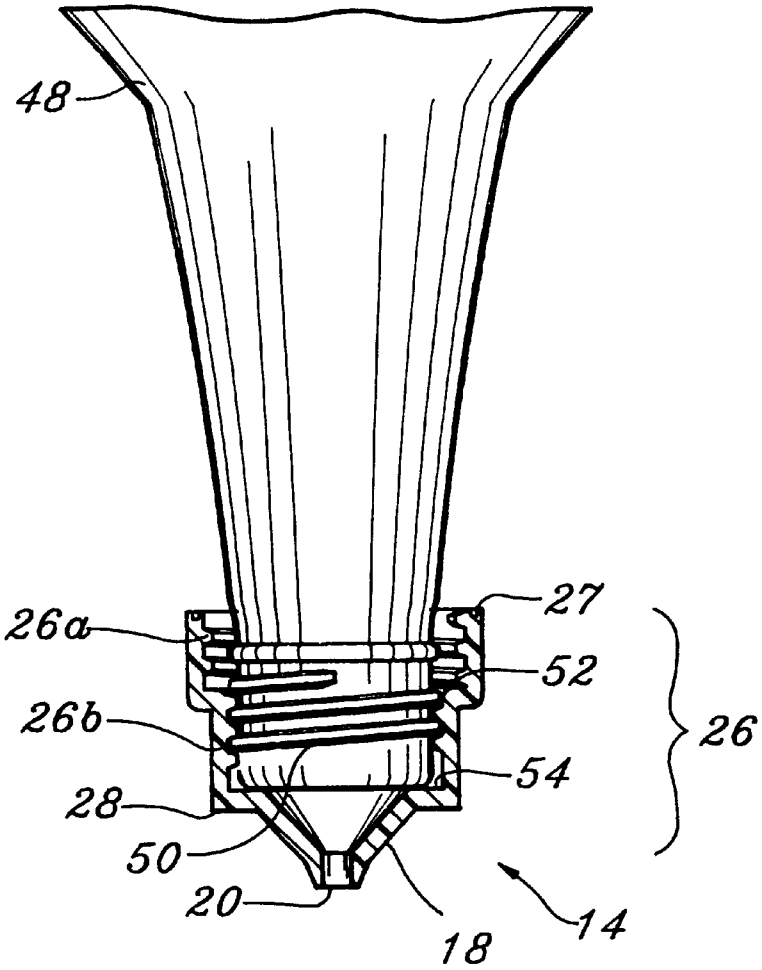

The versatility of the improved support closure is increased by providing two sets of internal threads 26*a*, 26*b*. Referring to FIG. 8 of the drawing, portions of a container 48 with small diameter externally threaded neck 50 is shown threaded into the smaller diameter threads 26*b*. The cap is shown in cross-section to include an upper sealing ledge 52 and a lower ledge 54 extending inwardly of the respective internal threads 26*a*, 26*b*. The edge of neck 50 is forced against lower ledge 54 to seal against leakage.

Figure 9:
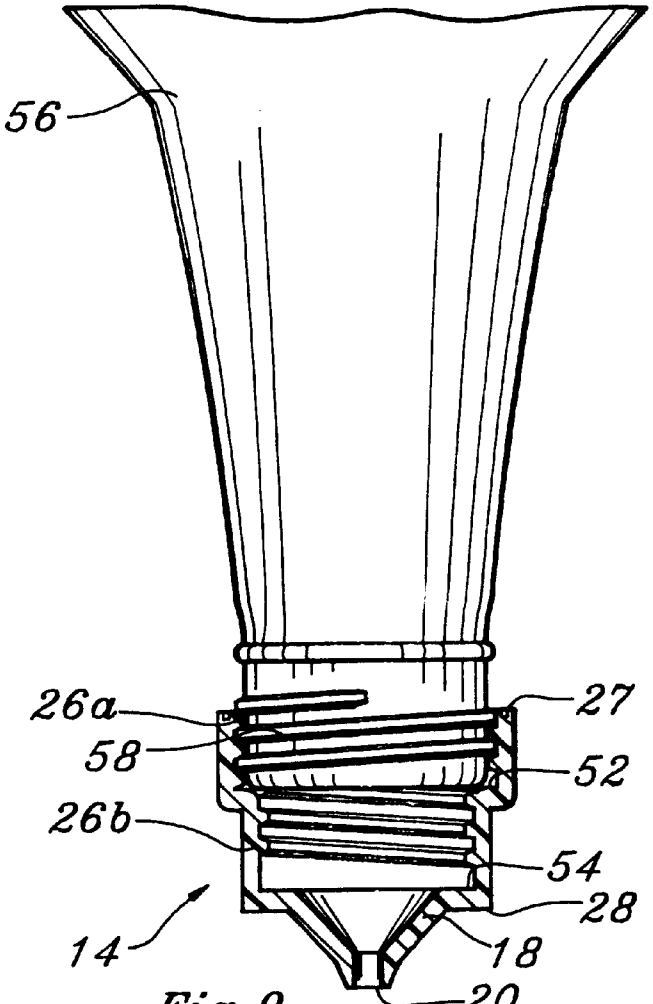

FIG. 9 illustrates a container 56 with a larger diameter externally threaded neck 58 threaded into the larger diameter internal threads 26*a*. The edge of container neck 58 is forced against upper ledge 52 to seal against leakage.

Since there is some standardization between container neck thread sizes and diameters, two internal thread diameters with accompanying sealing ledges increase the versatility of the support closure and will handle most standard containers. Of course, additional thread sizes and diameters may be added, or the thread pitch changed between different diameters, as desired.

While there is disclosed what is considered to be the preferred embodiment of the invention, it is desired to claim all such modifications as fall within the true spirit and scope of the invention.

What is claimed is:

1. An improved supporting closure for a container adapted to hold a viscous liquid and having an externally threaded neck on one end thereof, comprising:

a dispensing cap having an internally threaded section arranged to fit said threaded neck, a projecting end piece defining an dispensing outlet, and a lateral projection disposed between the dispensing outlet and the threaded section defining a first pivot member thereon, and a container support comprising a substantially dish-shaped member with a peripheral skirt terminating in a peripheral edge adapted to rest on a flat supporting surface, said dish-shaped member defining a central recessed section, said central recessed section adapted to receive said projecting end piece and defining means to block said dispensing outlet, said dish-shaped member defining a second pivot member disposed between the peripheral edge and the central recessed section and adapted to cooperate with the first pivot member, said second pivot member being located and arranged so that the projecting end piece of the dispensing cap will pivot into the central recessed section of the container support to block the dispensing outlet, whereby the dish-shaped member may serve as a support to hold the container in an inverted position, and whereby the projecting end piece of the dispensing cap is pivotable out of the central recessed section to permit dispensing viscous liquid from the dispensing outlet.

2. The combination according to claim 1, wherein said internally threaded section on the dispensing cap comprises a plurality of coaxial threaded portions joined together and each having different diameters.

3. The combination according to claim 1, wherein said lateral projection comprises a pair of lateral arms and a pivot pin extending therebetween, and wherein said second pivot member comprises a chordal recess in said dish-shaped member.

4. The combination according to claim 3, wherein the dish-shaped member further includes a chordal slot adjacent and parallel to the chordal recess and further defines an overhang adjacent the chordal recess, whereby the first pivot member may be held in the chordal recess with a snap fit due to resilience of the dish-shaped member provided by the chordal slot.

5. The combination according to claim 1, wherein said projecting end piece and said centrally recessed section define a reservoir for any excess liquid.

6. The combination according to claim 5, wherein said dispensing outlet blocking means comprises a projecting plug in the center of said central recessed section.

7. The combination according to claim 1, wherein said central recessed section has a flat bottom surface substantially coplanar with said peripheral edge.

8. The combination according to claim 1, wherein the dispensing cap includes a peripheral rim surrounding the projecting end piece and wherein said dish-shaped member includes a ledge support adapted to receive the peripheral rim when the projecting end piece is received within the central recessed section.

9. An improved supporting closure for a plurality of containers adapted to hold viscous liquids, said containers having externally threaded necks of different diameters, comprising:

a dispensing cap having a threaded section comprising a plurality of coaxial, internally threaded portions of different diameters arranged to fit said respective threaded necks of the containers, a projecting, substantially conical end piece defining an dispensing outlet, lateral projection means disposed between the dispensing outlet and the threaded section and a pivot pin supported on the lateral projection means, and a container support comprising a substantially dish-shaped member with a peripheral skirt terminating in a peripheral edge adapted to rest on a flat supporting surface, said dish-shaped member defining a central recessed section, said central recessed section adapted to receive said projecting end piece together and defining projecting plug means to lock said dispensing outlet, said dish-shaped member defining a chordal recess disposed between the peripheral edge and the central recessed section and adapted to receive and cooperate with the pivot pin, said chordal recess being located and arranged so that the projecting end piece of the dispensing cap will pivot into the central recessed section of the container support to block the dispensing outlet, whereby the dish-shaped member may serve as a support to hold the container in an inverted position, and whereby the projecting end piece of the dispensing cap is pivotable out of the central recessed section to permit dispensing viscous fluid from the dispensing outlet.

* * * * *

UNITED STATES PATENT AND TRADEMARK OFFICE

CERTIFICATE OF CORRECTION

PATENT NO. : 6,095,374
DATED : August 1, 2000
INVENTOR(S) : Paul J. Ricard, et al.

It is certified that error appears in the above-identified patent and that said Letters Patent is hereby corrected as shown below:

On the title page, item:

[75] Inventors: Paul J. Ricard, Amherst; David Kroll, Westfield; Robert Engman, Easthampton; Peter A. Laird, Whately, all of Mass.

Signed and Sealed this

Twelfth Day of December, 2000

*Attest:*

Q. TODD DICKINSON

*Attesting Officer*

*Director of Patents and Trademarks*